United States Patent [19]

Yates

[11] Patent Number: 4,553,642

[45] Date of Patent: Nov. 19, 1985

[54] BRAKE ARRANGEMENT FOR SINGLE AXLE WHEEL TRUCK OF RAILWAY CAR

[75] Inventor: Donald B. Yates, Homewood, Ill.

[73] Assignee: Pullman Standard Inc., Chicago, Ill.

[21] Appl. No.: 542,443

[22] Filed: Oct. 17, 1983

[51] Int. Cl.[4] ..... B61H 13/36

[52] U.S. Cl. ..... 188/56; 188/209; 188/213; 188/233.3

[58] Field of Search ..... 188/56, 153 R, 190, 188/193, 207, 209, 212, 213, 219.1, 233.3

[56] References Cited

U.S. PATENT DOCUMENTS

| | | | |
|---|---|---|---|
| 417,953 | 12/1889 | Susemihl | 188/213 |
| 436,297 | 9/1890 | Bayley | 188/207 |
| 842,474 | 1/1907 | Lightbody | 188/213 |
| 1,335,187 | 3/1920 | Peycke | 188/213 |
| 1,443,838 | 1/1923 | Gilpin | 188/56 |
| 1,896,961 | 2/1933 | Latshaw | 188/56 |
| 2,155,222 | 4/1939 | Farmer | 188/56 |
| 2,215,351 | 9/1940 | Farmer | 188/207 |
| 2,873,823 | 2/1959 | Couch | 188/209 |
| 2,883,005 | 4/1959 | Polanin | 188/56 X |
| 2,911,073 | 11/1959 | Holin | 188/56 X |
| 2,968,371 | 1/1961 | Holin | 188/190 |
| 3,643,766 | 2/1972 | Roush, Jr. | 188/190 |

*Primary Examiner*—Duane A. Reger
*Assistant Examiner*—Richard R. Diefendorf
*Attorney, Agent, or Firm*—Richard J. Myers & Assoc.

[57] ABSTRACT

The brake beams of a single axle railway car wheel truck are swingingly suspended from a body portion of the car and engage with the axle housings of the wheel and axle assembly to enable the brake beams to move laterally and longitudinally with the wheel and axle assembly when this assembly is forced to move with respect to the body portion of the car. Movement of the brake beams with the wheel and axle assembly enables the brake heads on the brake beams to be properly aligned with braking surfaces on the wheels under substantially all operating conditions of the wheel truck even though substantially all of the weight of the brake beam and actuator assemblies is borne by the body portion of the railway car.

17 Claims, 9 Drawing Figures

FIG. 7
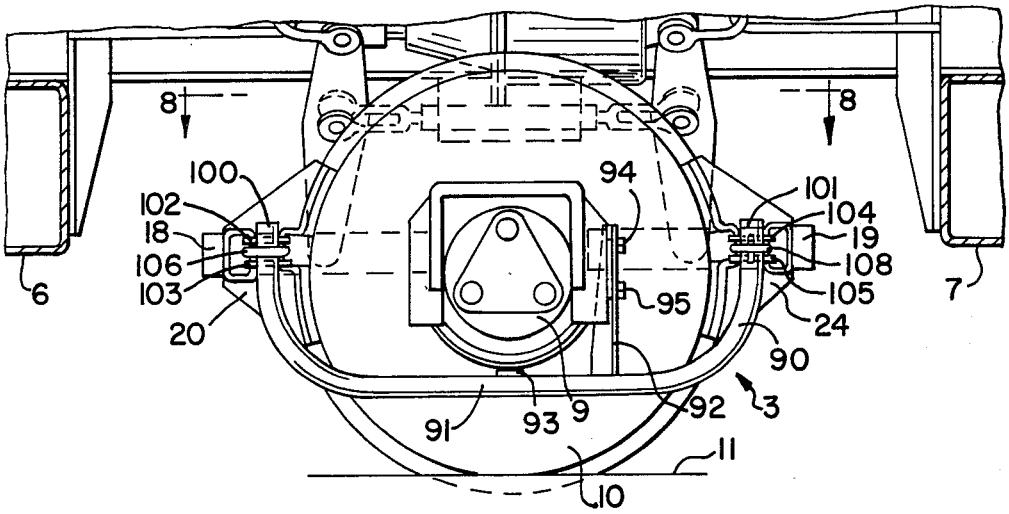
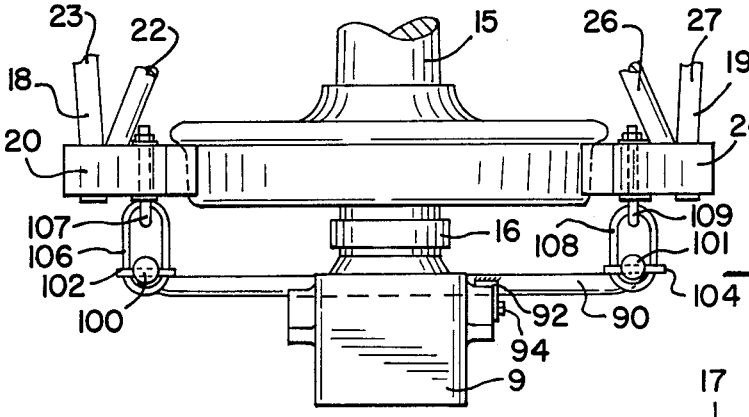
FIG. 8
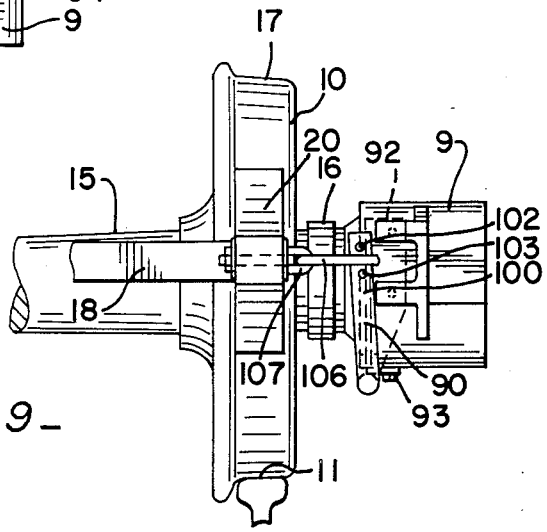
FIG. 9

BRAKE ARRANGEMENT FOR SINGLE AXLE WHEEL TRUCK OF RAILWAY CAR

BACKGROUND OF THE INVENTION

1. Field of the Invention

This invention relates to brake beams connected for operable engagement with the wheels of a single axle wheel truck of a railway car in which the wheel and axle assembly is allowed a limited amount of lateral and longitudinal movement with respect to the body portion of the car.

2. Description of the Prior Art

Single axle railway trucks typically have a wheel and axle assembly which must be able to undergo a limited amount of lateral and longitudinal movement with respect to the rest of the truck components and the body portion of the car it rollingly supports. Such movement is necessary to enable the truck to conform to trackage anomalies and curvatures without incurring derailment.

The need for such movement of the wheel assembly with respect to the car creates problems in maintaining the brake shoes of the brake system continually aligned for proper engagement with the wheel treads of the wheels. When the brake beams are attached to the car body frequent misalignment occurs which causes either rubbing of the shoes against the wheel when the brakes are not applied and less than optimum braking action when the brakes are applied.

Attempts to overcome these disadvantages by supportingly attaching the brake beams to the wheel truck create the need for complex and costly constructions.

SUMMARY OF THE INVENTION

The brake beams and actuating brake cylinder are swingingly or movably suspended from and supported by the body portion of a railway car and attached to the wheel housings of a single axle wheel and axle assembly. This arrangement causes the brake beams and the brake shoes on them to be effectively aligned with the wheel treads on the wheels as the wheel and axle assembly moves with respect to the body portion of the car.

BRIEF DESCRIPTION OF THE DRAWINGS

FIG. 7 is an enlarged partial elevation view of the axle housing assembly of the wheel truck shown in FIGS. 1 and 2;

FIG. 8 is a sectional top view of FIG. 7 as indicated by the section lines 8—8; and FIG.9 is an end view of FIG. 8.

DETAILED DESCRIPTION OF THE PREFERRED EMBODIMENT

Figure 1:
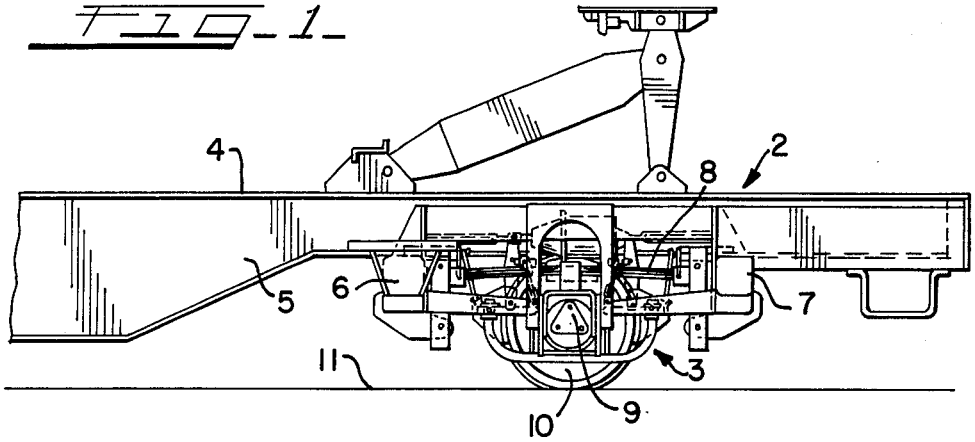
FIG. 1 is a side elevation view of an end of a railway car having a single axle wheel truck having the brake arrangement of this invention.

FIG. 1 shows a side elevation view of an end portion of a railway car 2 having a single axle wheel truck assembly 3 having the brake arrangement of this invention.

Car 2 is comprised of a lading or cargo carrying surface 4 and a longitudinally extending draft and load support member, such as conventional box type center sill 5.

A pair of transversely extending bolsters 6 and 7 are rigidly affixed to center sill 5 and a pair of suspension springs, such as suspension spring 8, is attached to the bolsters and to a pair of axle housing assemblies, such as axle housing assembly 9, to resiliently suspend the car body portion comprised of center sill 5 and the bolsters 6 and 7 on the axle housings.

A single axle wheel and axle assembly having two wheels, of which one wheel 10 is shown, is rollingly engaged with axle housing assembly 9 and a similar housing (not shown) on the other side of the truck to enable rolling movement of the car on a suitable surface, such as rail top 11.

Figure 2:
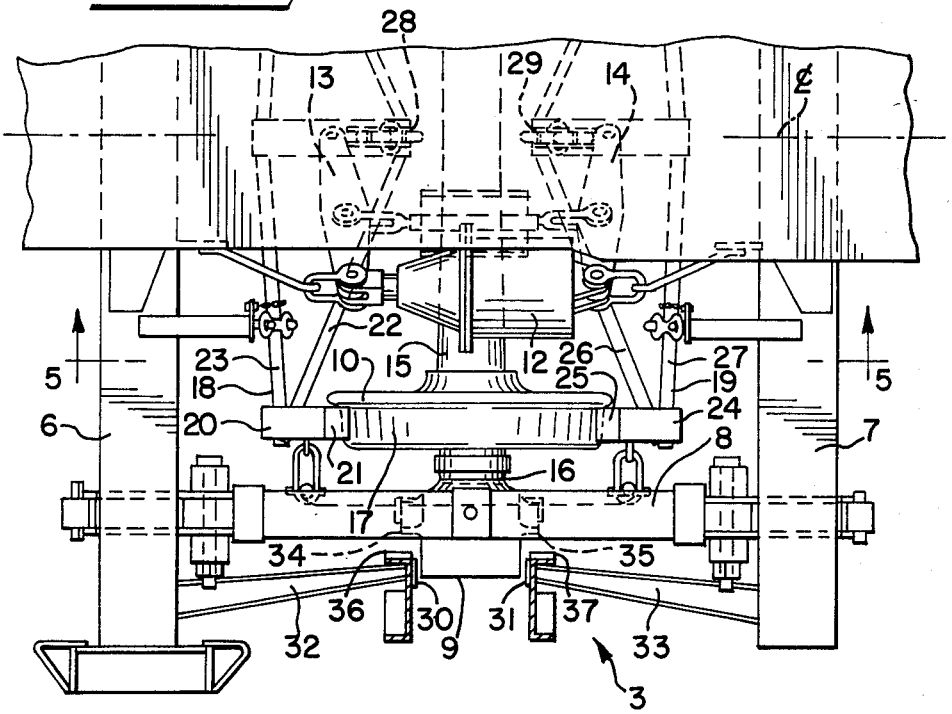
FIG. 2 is a top view of substantially one half of the wheel truck shown in FIG. 1.

FIG. 2 shows an enlarged top view of substantially one half of the single axle wheel truck assembly 3 shown in FIG. 1. As shown, the wheel truck would be substantially symmetrical about center line CL except that only one linear force imposing means, such as fluid pressure operated cylinder 12 and one set of means for operatively connecting the cylinder, such as brake levers 13 and 14, are used for each wheel truck. Some components not essentially to an understanding or function of the invention disclosed in this specification have been omitted from the view for clarity.

Wheel truck assembly 3 is comprised of an axle 15 having a first end portion 16 to which wheel 10 is engaged. End portion 16 is rollingly engaged with axle housing assembly 9. Wheel 10 has a wheel tread 17 for engaging the track it travels on and also to coact with brake shoes to provide resistance to rolling.

Assembly 3 has a first brake beam 18 on a first side of axle 15 and a second brake beam 19 on a second side of axle 15. Brake beam 18 is comprised of two brake heads, of which one is brake head 20, having a brake shoe 21 and a tension member 22 and a compression member 23. Similarly, brake beam 19 has two brake heads of which one is brake head 24 having a brake shoe 25 and a tension member 26 and a compression member 27.

As shown, each brake beam 18 and 19 has a center section 28 and 29, respectively, and brake levers 13 and 14, respectively, are pivotally connected to these center sections.

FIG. 2 shows each of the brake shoes 21 and 25 in correct alignment with the wheel tread 17 of wheel 10 and it is this alignment or relationship that it is desirable to maintain at all times despite the fact that the wheel and axle assembly, including the axle housing 9, can move longitudinally between axle stop surfaces 30 and 31 on axle stop members 32 and 33, respectively, and can also move laterally until lateral limit flanges 34 and 35 on the axle housing 9 contact lateral axle stop surfaces 36 and 37 on axle stop members 32 and 33. Suspension spring 8 tends to resiliently maintain the relationship of axle housing 9 to the axle stop limit surfaces 30, 31, 36 and 37 of axle stop members 32 and 33 as shown in FIG. 2 but track curvatures and conditions, such as track unevenness, force the wheel and axle assembly to move into frequent contact with the limit surfaces under normal operating conditions. It is this movement of the wheel and axle assembly with respect to the car body which forces the brake shoes out of alignment with the wheel tread when the brake beams are suspended from the car body in a manner which does not permit lateral movement of the brake beams.

Figure 3:
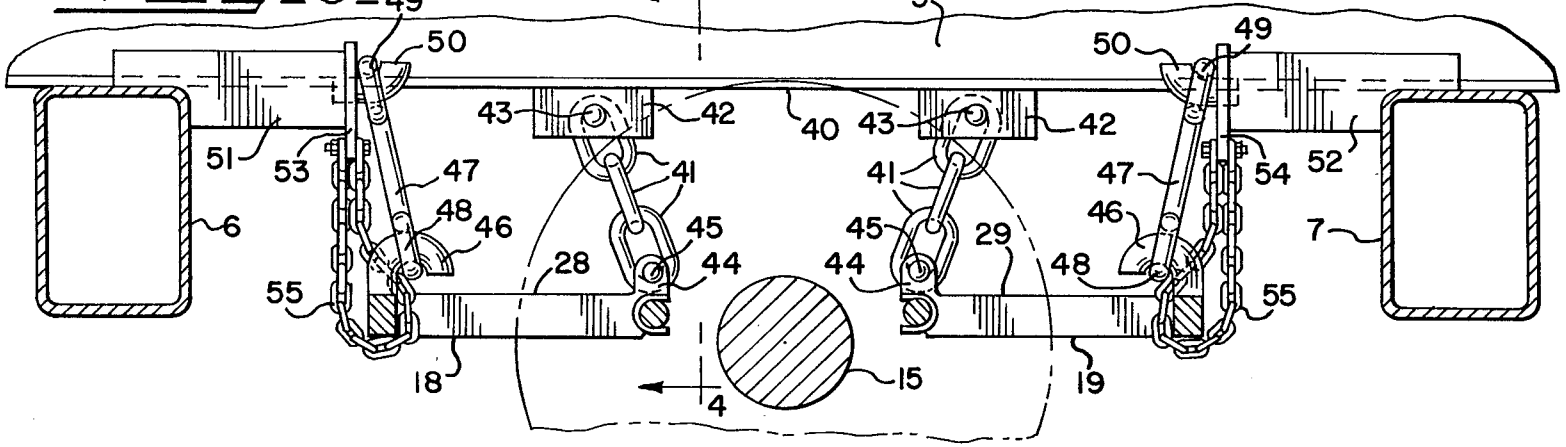
FIG. 3 is an enlarged partial elevation view of the wheel truck shown in FIG. 2 showing the suspension of the brake beams.
Figure 4:
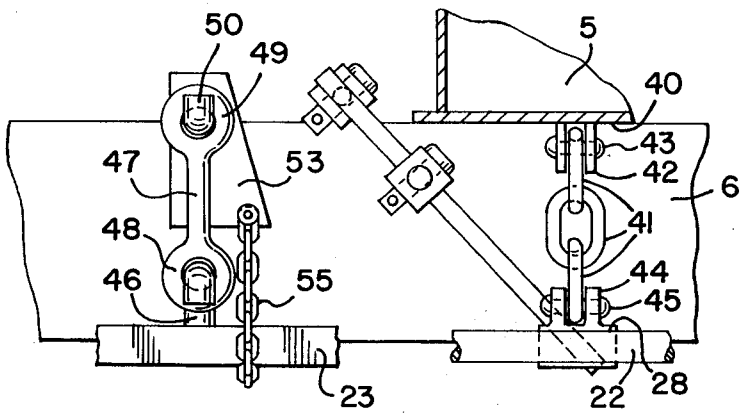
FIG. 4 is an enlarged partial view of FIG. 3, as indicated by section lines 4—4 on FIG. 3.

FIG. 3 is an enlarged partial view of the brake arrangement shown in FIG. 2 from which some components have been omitted to enable a readily understandable illustration of how the brake beams are suspended from the car body and FIG. 4 is a sectional view of FIG. 3.

Referring to FIGS. 3 and 4, brake beams 18 and 19 have their center sections 28 and 29 flexibly suspended from the underside 40 of center sill 5 by a plurality of interconnected chain links 41 which are pivotally connected at a first or upper end to a bracket 42, which is welded to center sill 5, by a pivot pin 43. Links 41 are pivotally connected at a second or lower end to an appropriate attachment bracket 44 by a pivot pin 45. Laterally outwardly from the center section a pair of attachment hooks such as hooks 46, are rigidly attached to the compression member of each brake beam. Each attachment hood is round in cross section. A suspension link 47 having an annular loop at each lower end 48 and upper end 49 supportingly receives at attachment hook 46 in lower loop 48. Upper loop 49 receives an attachment hook 50, also round in cross section, which is rigidly affixed to one of the bolsters 6 or 7 by cantilevered brackets 51 and 52 which are rigidly affixed to the bolsters and attachment hooks 40 are rigidly affixed to the brackets. Each bracket 51 and 52 has an end plate 53 and 54, respectively, affixed to its terminal end and a retaining or safety chain 55 is looped around the compression member of each brake beam and attached to the end plate as a back-up or failsafe suspension for the brake beams.

It will be seen that each brake beam suspended from the body portion of railway car 2, as shown and described is capable of both lateral and longitudinal movement with respect to the body portion of the car while being maintained at substantially the same elevation or level with respect to the car body and moveable vertically with respect to the axle.

Figure 5:
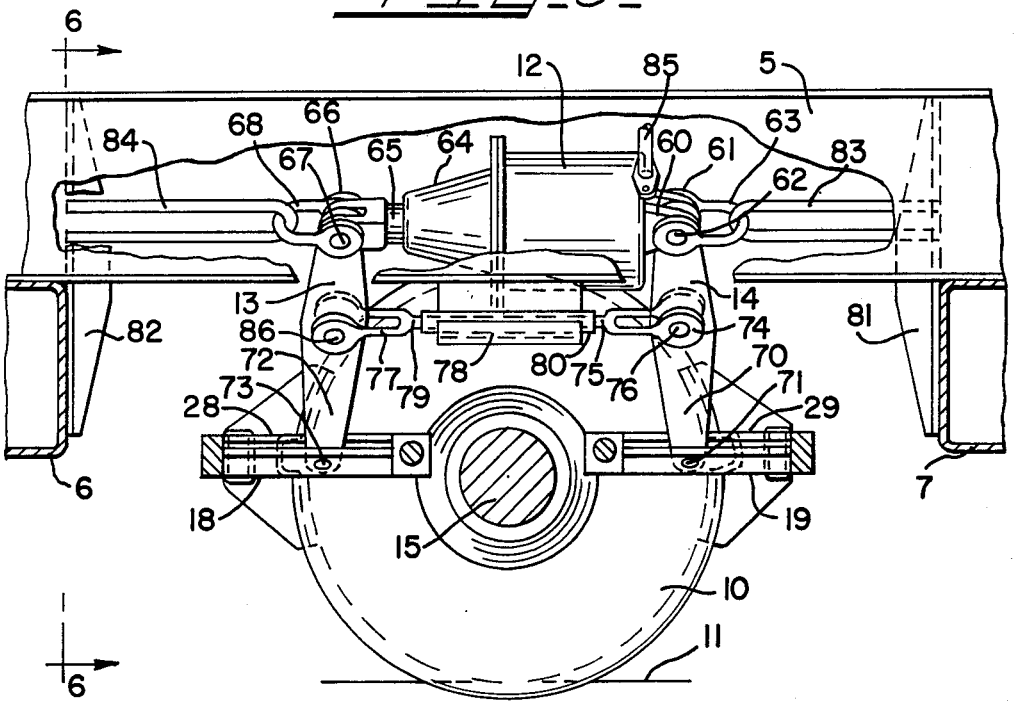
FIG. 5 is an enlarged partial view of the wheel truck shown in FIGS. 1 and 2 showing attachment of the brake cylinder.
Figure 6:
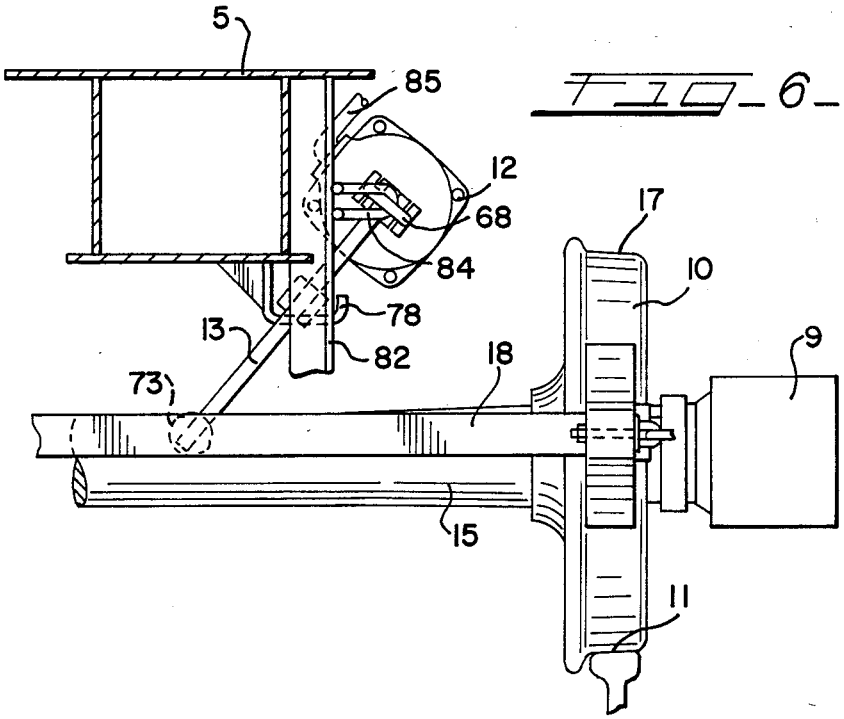
FIG. 6 is an end view of FIG. 5 as shown by the section lines 6—6.

FIG. 5 is an enlarged elevation view of the brake cylinder assembly and the connections shown in FIG. 2 in which other components have been omitted for clarity and FIG. 6 is a section view of FIG. 5 as indicated by the section line 6—6.

Referring to FIGS. 5 and 6, a linear force imposing member, such as pressurized fluid actuated brake cylinder 22, has a body or cylinder end portion 60 pivotally engaged to an upper end portion 61 of brake lever 14 by a pivot pin 62. Also pivotally attached to cylinder end portion 60 by pin 62 is a clevis 63. At an opposite or rod end portion 64 of cylinder 12 a pushrod 65 is pivotally engaged with an upper end portion 66 of brake lever 13 by a pivot pin 67 and a clevis 68 is also pivotally attached to the cylinder pushrod 65 by pin 67.

A lower end portion 70 of lever 14 is pivotally engaged with the center section 29 of brake beam 19 by a pivot pin 71 and a lower end portion 72 of brake lever 13 is pivotally engaged with the center section 28 of brake beam 18 by a pivot pin 73.

Intermediate its upper and lower end portions 61 and 70 lever 14 has a clevis 74 of a connecting link 75 pivotally engaged to the lever 14 by a pivot pin 76. Also, intermediate the upper and lower ends 66 and 72 of lever 13 a clevis 77 of connecting link 75 is affixed to lever 13 by a pivot pin 86. Connecting link 75 rests in a support bracket 78 which is rigidly attached to the center sill 5 and is comprised of a rod 79 surrounded by an elastomeric sleeve 80. The sleeve prevents rattling and wear between the bracket and the rod.

Affixed to bolster 7 is a support member 81 and affixed to bolster 6 is a support member 82. To each of these support members 81 and 82 is affixed a longitudinally extending cylinder centering link 83 and 84, respectively, which extends from the support members toward the cylinder 12. Clevis 68 is engaged with link 84 and clevis 63 is engaged with link 83. Centering links 83 and 84 serve to movably center cylinder 12 in the preferred position substantially as shown in FIG. 5 when the brakes are in the "brake-off" position. An air line 85 places cylinder 12 in fluid flow communication with a source of pressurized air remote from the car 2.

When pressurized air is admitted to cylinder 12, pushrod 65 is forced out of the cylinder to lengthen the distance between, or spread apart, the two top end portions of levers 13 and 14 and the levers consequently pivot about the pivot pins 76 and 86 of fixed connecting link 85. Consequently, the brake beams 18 and 19 pivotally connected to the lower ends of the levers are forced toward each other and the brake shoes carried by the brake beams are forced into braking contact with the wheel treads of the wheels. When air pressure is removed from cylinder 12, a spring within cylinder 12 retracts pushrod 65 back into the cylinder to return the assembly to the brake-off, cylinder-centered position as shown in FIG. 5. Cylinder 12 is esentially supported on levers 13 and 14 and can therefore move with the brake beams as they move with respect to the body portion of the car to remain aligned with the wheels.

FIG. 7 is an enlarged elevation view of the wheel truck 3 shown in FIGS. 1 and 2 from which components have been removed to show the axle housing and its relationship to the brake beams. FIG. 8 is a sectional view of FIG. 7 as indicated by the section lines 8—8 of FIG. 9 is an end view of FIG. 8.

Referring to FIGS. 7, 8 and 9, axle housing 9, to which end portion 16 of axle 15 is rollingly engaged, is provided with a brake beam position member 90. Member 90 is substantially U-shaped and the bottom portion or bight 91 of the U is rigidly, but removably, attached to the axle housing by having a mounting bracket 92 and an attaching plate 93 welded to member 90 and affixing the brackets to wheel housing 9 with appropriate means, such as threaded fasteners 94, 95 and 96.

Member 90 has a first upstanding or upwardly extending leg portion 100 an a second upstanding or upwardly extending leg portion 101. A pair of stop pins 102 and 103 are affixed to portion 100 and a pair of stop pins 104 and 105 are affixed to portion 101.

Between pins 102 and 103 of portion 100 a brake beam positioner connection means, such as connection link 106, is connected and extends laterally inward for engagement with an eye bolt 107 which is connected to brake head 20 of brake beam 18. Similarly, between pins 104 and 105 of portion 101 a connection link 108 is connected and extends laterally inward for engagement with an eye bolt 109 which is connected to brake head 24 of brake beam 19. Corresponding components in a substantially mirror image arrangement would support the opposite ends of brake beams 18 and 19.

By having the brake beams 18 and 19 engaged with the axle housing of the wheel and axle assembly as shown in FIGS. 7, 8 and 9, the brake beams at all times move with the wheel and axle assembly to assure that the brake shoes of the brake heads remain properly aligned with the wheel treads.

Because the brake beams are flexibly or movably and supportedly suspended from the car body portion of the car and the brake cylinder is substantially supported on the brake beams and flexibly or movably attached to the body portion of the car this arrangement allows the brake system to be supported by the body portion of the car, enables the brake beams to move laterally and longitudinally with respect to the body portion as the wheel and axle assembly moves and provides a relatively structurally simple, light weight and economic brake arrangement whereby the brake shoes remain operatively aligned with the wheel treads under substantially all operating conditions of the car.

What is claimed is:

1. In a brake arrangement for a single axle wheel truck for a railway car having a car body portion, said truck having a wheel and axle assembly including an axle having a wheel mounted adjacent an end portion, said wheel having a braking surface and said end portion of said axle being rollingly engaged with an axle housing, the improvement comprising:

a pair of brake beams, each of said brake beams being positioned on opposite sides of said axle and having a brake head for brakingly contacting said braking surface on said wheel;

means for movably suspending said brake beams from said body portion of said car for enabling said brake beams to move laterally and longitudinally with respect to said body portion of said car;

means for selectively forcing said brake heads of said brake beams into braking engagement with said braking surface of said wheel, said forcing means being movingly supported on said body portion of said car and on said brake beams; and engaging means being connected to said brake beams and said axle housing and engaging each of said brake beams to said axle housing for causing said brake beams to move with said wheel and axle assembly when said wheel and axle assembly moves laterally and longitudinally with respect to said body portion of said car for maintaining said brake heads aligned with said braking surface on said wheel under substantially all operating conditions of said wheel truck, and said engaging means having means limiting lateral and longitudinal movement of the brake beams relative to the axle housing whereby said brake beams are forced to move with said wheel assembly and are able to move with respect to said body portion of said railway car for maintaining said brake beams operatively aligned with said wheel assembly.

2. The invention as defined in claim 1 in which said movably suspending means is comprised of a plurality of suspension links having an annular loop at each end and one end of each link is engaged with an attachment hook affixed to a brake beam and another end of each link is engaged with an attachment hook affixed to said body portion of said car for swingingly suspending said brake beams from said body portion of car.

3. The invention as defined in claim 2 in which each of said attachment hooks are round in cross section.

4. The invention as defined in claim 2 together with a plurality of interconnected chain links for swingingly suspending a center section of each of said brake beams from said body portion of said car.

5. The invention as defined in claim 1 in which said engaging means is comprised of a brake beam positioner member fixedly attached to said axle housing and connective links extending between said positioner member and said brake beams for causing said brake beams to move with said axle housing to maintain said brake heads aligned with said braking surface on said wheel.

6. The invention according to claim 1 and said means for selectively forcing the brake heads comprising:

a force imposing means movably attached to said body portion of said railway car; and means for operatively connecting said force imposing means with each of said brake beams.

7. The invention as defined in claim 6 in which said suspending means supportingly engages each of said brake beams with said body portion of said car and is comprised of link members swingingly mounted to said body portion of said car and to each of said brake beams.

8. The invention as defined in claim 6 in which said engaging means is a brake beam positioner mounting member being rigidly affixed to said axle housing and each of said brake beams is attached to said member.

9. The invention as defined in claim 8 in which one end of each of said brake beams is attached to said mounting member and said beams are attached to said member by connection links.

10. The invention as defined in claim 6 in which said operatively connecting means are two brake levers.

11. In a brake arrangement for a single axle wheel truck for a railway car having a car body portion, said truck having a wheel and axle assembly including an axle having a wheel mounted adjacent an end portion, said wheel having a braking surface and said end portion of said axle being rollingly engaged with an axle housing, the improvement comprising:

a pair of brake beams, each of said brake beams being positioned on opposite sides of said axle and having a brake head for brakingly contacting said braking surface on said wheel;

means for movably suspending said brake beams from said body portion of said car for enabling said brake beams to move laterally and longitudinally with respect to said body portion of said car;

means for selectively forcing said brake heads of said brake beams into braking engagement with said braking surface of said wheel, said forcing means being movingly supported on said body portion of said car and on said brake beams; and means for engaging each of said brake beams to said axle housing for causing said brake beams to move with said wheel and axle assembly when said wheel and axle assembly moves laterally and longitudinally with respect to said body portion of said car for maintaining said brake heads aligned with said braking surface on said wheel under substantially all operating conditions of said wheel truck, said engaging means comprising a brake beam positioner member attached to said axle housing and connective links extending between said positioner member and said brake beams for causing said brake beams to move with said axle housing to maintain said brake heads aligned with said braking surface on said wheel, and said positioner member being substantially U-shaped and a lower portion of the U being rigidly affixed to the axle housing and upstanding leg portions being longitudinally spaced from each of two sides of said axle housing and one of said brake beams being engaged with each upstanding leg portion.

12. The invention as defined in claim 11 in which a connective link is engaged with each upstanding leg portion of said positioner member and each connective link extends laterally inward and is engaged with an eye of an eye bolt which is engaged with a brake head of a brake beam.

13. In a brake arrangement for a single axle wheel truck for a railway car having a car body portion, said truck having a wheel and axle assembly including an axle having a wheel mounted adjacent an end portion, said wheel having a braking surface and said end portion of said axle being rollingly engaged with an axle housing, the improvement comprising:

a pair of brake beams, each of said brake beams being positioned on opposite sides of said axle and having a brake head for brakingly contacting said braking surface on said wheel;

means for movably suspending said brake beams from said body portion of said car for enabling said brake beams to move laterally and longitudinally with respect to said body portion of said car;

means for selectively forcing said brake heads of said brake beams into braking engagement with said braking surface of said wheel, said forcing means being movingly supported on said body portion of said car and on said brake beams; and means for engaging each of said brake beams to said axle housing for causing said brake beams to move with said wheel and axle assembly when said wheel and axle assembly moves laterally and longitudinally with respect to said body portion of said car for maintaining said brake heads aligned with said braking surface on said wheel under substantially all operating conditions of said wheel truck, and said forcing means is comprised of a fluid pressure actuated brake cylinder having a cylinder end and a pushrod end and a first brake lever is pivotally attached to said cylinder end and a second brake lever is pivotally attached to said pushrod end and each of said levers is pivotally attached to one of said brake beams and a fixed length connective link is pivotally engaged with an intermediate portion of each of said brake levers whereby when said brake cylinder is actuated it increases in length for forcing said brake levers to pivot about their respective pivotally engaged portions with said connective link for forcing said brake heads on said brake beams into braking contact with said braking surface on said wheel.

14. The invention as defined in claim 13 together with a J-shaped bracket affixed to said body portion of said car and said connective link is movably supported by said bracket for aiding in maintaining said forcing means movably attached to said body portion of said car.

15. The invention as defined in claim 13 together with a first clevis pivotally engaged with said cylinder end of said brake cylinder and a second clevis pivotally engaged with said pushrod end of said brake cylinder and a first and a second centering link rigidly affixed to said body portion of said car and said first clevis is movably engaged with said first centering link and said second clevis is movably engaged with said second centering link for maintaining said brake cylinder in a substantially centered position when said brake cylinder is in a nonextended brake-off position.

16. In a railway car having a body portion and a single axle wheel truck, said truck having an axle having an end portion and a wheel having a braking surface wheel tread, said wheel being mounted adjacent said end portion of said axle and said end portion of said axle being rollingly engaged with an axle housing, an improved brake arrangement comprising:

a force imposing means movably attached to said body portion of said railway car;

a first brake beam on a first side of said axle and a second brake beam on a second side of said axle, each of said brake beams having a set of brake shoes for frictionally engaging said wheel tread of said wheel and each of said brake beams being swingingly engaged with said body portion of said car by linkage means for enabling lateral and longitudinal movement of each of said brake beams relative to said body portion of said car;

means for operatively connecting said force imposing means with each of said brake beams; and means for engaging each of said brake beams with said axle housing;

whereby said brake beams are enabled lateral and longitudinal movement with respect to said body portion of said car in response to movement of said axle housing for maintaining said brake shoes operatively aligned with said wheel tread of said wheel under substantially all operating positions of said wheel truck; and said force imposing means being a fluid pressure operated cylinder movably attached to said body portion of said car by at least two centering links.

17. In a railway car having a body portion and a single axle wheel truck, said truck having an axle having an end portion and a wheel having a braking surface wheel tread, said wheel being mounted adjacent said end portion of said axle and said end portion of said axle being rollingly engaged with an axle housing, an improved brake arrangement comprising:

a force imposing means movably attached to said body portion of said railway car;

a first brake beam on a first side of said axle and a second brake beam on a second side of said axle, each of said brake beams having a set of brake shoes for frictionally engaging said wheel tread of said wheel and each of said brake beams being swingingly engaged with said body portion of said car by linkage means for enabling lateral and longitudinal movement of each of said brake beams relative to said body portion of said car;

means for operatively connecting said force imposing means with each of said brake beams; and means for engaging each of said brake beams with said axle housing;

whereby said brake beams are enabled lateral and longitudinal movement with respect to said body portion of said car in response to movement of said axle housing for maintaining said brake shoes operatively aligned with said wheel tread of said wheel under substantially all operating positions of said wheel truck; and said engaging means is a brake beam positioner mounting member being ridigly affixed to said axle housing and each of said brake beams is attached to said member; and said member is U shaped and the bottom portion of the U is affixed to the axle housing and each of the upstanding leg portions of the U are attached to a brake beam.

* * * * *